US005666043A

United States Patent [19]

Henry et al.

[11] Patent Number: 5,666,043

[45] Date of Patent: Sep. 9, 1997

[54] VOLTAGE DETECTOR WITH TRIGGER BASED ON OUTPUT LOAD CURRENCY

[75] Inventors: Peter S. Henry, Fremont; Evaldo M. Miranda, San Jose, both of Calif.

[73] Assignee: Analog Devices, Inc., Norwood, Mass.

[21] Appl. No.: 679,494

[22] Filed: Apr. 12, 1996

Related U.S. Application Data

[63] Continuation of Ser. No. 479,662, Jun. 7, 1995, abandoned.

[51] Int. Cl.[6] ..... G05F 1/573; G05F 1/44

[52] U.S. Cl. ..... 323/277; 323/280

[58] Field of Search ..... 323/276, 279, 323/280, 281, 274, 277

[56] References Cited

U.S. PATENT DOCUMENTS

| | | | |
|---|---|---|---|
| 4,254,372 | 3/1981 | Moore, Jr. | 323/277 |
| 4,667,145 | 5/1987 | Moreau | 323/275 |
| 4,684,878 | 8/1987 | Giordano | 323/279 |
| 5,390,147 | 2/1995 | Smarandoiu | 365/185 |

OTHER PUBLICATIONS

LP2951 Data Sheet From National Semiconductor.

Paul Horowitz, Winfield Hill, *The Art of Electronics*, Cambridge University Press, New York, 1989, pp. 917–932 and 938–940.

H. E. Lin, Electronics Designers'Handbook, Robert W. Landee, Donovan C. Davis, Albert P. Albrecht editors, McGraw Hill Book Company, New York, 1977, pp. 11–24.

Phillip E. Allen, Douglas R. Holberg, *CMOS Analog Circuit Design*, Holt, Rinehart and Winston, Inc., New York, 1985, pp. 95–101.

*Primary Examiner*—Peter S. Wong
*Assistant Examiner*—Bao Q. Vu
*Attorney, Agent, or Firm*—Koppel & Jacobs

[57] ABSTRACT

An alarm based upon the voltage across a linear regulator's pass transistor and the regulator's load current alerts operational circuitry which obtains power through the regulator when the voltage across the pass transistor may be insufficient for proper voltage regulation. The alarm's trigger voltage is adjusted in response to variations in the regulator's output current.

23 Claims, 3 Drawing Sheets

VOLTAGE DETECTOR WITH TRIGGER BASED ON OUTPUT LOAD CURRENCY

This is a continuation of application Ser. No. 08/479,662, filed on Jun. 7, 1995 now abandoned.

BACKGROUND OF THE INVENTION

1. Field of the Invention

This invention relates to voltage regulation circuitry, and more particularly to linear, or series, voltage regulation circuitry which provides an output signal that is activated when the voltage of an unregulated input voltage source may be insufficient for proper output voltage regulation.

2. Description of the Related Art

Voltage regulators are employed in nearly all electronics systems to convert available unregulated power to power at specified voltage levels. Series, or linear, voltage regulators employ a power transistor as a "pass" transistor between the unregulated input voltage and the regulated output voltage. As the input voltage and output current vary, feedback to the pass transistor, which is operated in the active region, causes the voltage drop across the transistor to compensate for these variations, and thus maintain the desired output voltage.

However, the pass transistor (typically a pnp transistor for low-dropout applications) requires a minimum voltage drop to maintain proper operation. If the input voltage drops to a level that does not provide this minimum voltage difference, or "headroom", across the pass transistor, the output voltage will fall out of regulation. If the voltage regulator could provide a signal, an alarm, which indicates that there is insufficient headroom to guarantee a properly regulated output voltage, the operational circuitry which relies upon the regulator for power could take measures to ensure that no data is lost, no in-correct commands are executed, that no logic states are mistakenly switched. In short, given such a warning, the operational circuitry could take action to prevent and correct errors and could also take steps to reduce power consumption. Unfortunately, headroom requirements vary widely from application to application.

Series regulators are available with alarm outputs which are triggered whenever the output voltage falls a given percentage out of regulation (e.g. the LP2951 series available from National Semiconductor, Corporation, Santa Clara, Calif. However, because the alarm is triggered when the output voltage is already out of regulation, there may be too little time for preventive and corrective measures. An alarm based upon the unregulated input voltage may provide greater warning to the system designer.

With additional circuitry and an extra pin on the voltage regulator's package, the regulator could accommodate various headroom requirements. That is, a designer employing the regulator could set the threshold input voltage at which the alarm signal is activated using a voltage divider and the anticipated requirements of a particular design. Naturally, the additional circuitry in the regulator, the extra pin on the regulator's package and the additional circuitry external to the regulator (i.e., its voltage divider) would increase the cost, volume and weight while reducing the reliability of any system employing such a design.

Portable, battery-powered systems are particularly vulnerable to the vagaries of voltage regulation. Over the course of discharging a battery its terminal voltage drops significantly. Portable system designers go to great lengths to extend the time a system may operate without requiring re-charging (or new batteries, if primary batteries are used).

The designer could always add batteries to increase the system's nominal operating capacity, but the added expense and particularly the added weight limits the utility of this approach.

To accommodate the reduction in terminal voltage that accompanies a battery's discharge, system designers add cells to the batteries, not just to add capacity at the system's nominal operating voltage, but to increase the initial terminal voltage of the battery. For example, an application that requires 1 mA @5 V for five hours may only operate two hours between charges from a battery composed of four 1.2 V cells. Initially, the cells may provide 1.4 V/cell but, by the time they've discharged 30% of their capacity (70% of nominal capacity remaining) they may provide only 1.0 V/cell, which is inadequate for 5 V operation. Typical battery discharge curves and design considerations may be found in Paul Horowitz, Winfield Hill, *The Art of Electronics*, Cambridge University Press, New York, 1989, pages 917–932. The addition of another cell, or possibly two, could extend operation to the five hour goal, but the additional cells increase the initial cost and weight of the system.

The system design is further complicated by the fact that the load may vary widely during operation. A printer or radio transmitter operating from the same battery as a laptop computer may impose significant but fleeting additional loads upon the battery. The increased load current causes an increased voltage drop across the voltage regulator's pass transistor. If, for example, the regulator's PNP pass transistor exhibits 30Ω collector resistance and at 1 mA the headroom required for regulation is 30 mV, at 100 mA the headroom requirement would be 3 V.

A system designer could include enough cells in the system to accommodate worst-case load current over the system's nominal period of operation, but this approach may unnecessarily burden the design (in terms of weight, cost and volume). A controller (microprocessor or other control circuit) could use an alarm signal which indicates that the regulator's input voltage is approaching the limit for proper regulation to initiate power-saving measures such as power-cycling, or other measures to extend the system's operation. For example, an alarm signal may prompt a laptop computer to dim its LCD backlight or to disable printing or transmitting data via an attached cellular modem, while also alerting the laptop user to the fact that the batteries must be re-charged. Such low-power design techniques are discussed in Paul Horowitz, Winfield Hill, *The Art of Electronics*, Cambridge University Press, New York, 1989, pages 938–940.

If the above-mentioned alarm is based solely upon the unregulated input voltage to the voltage regulator the alarm may be triggered when, in fact, a great deal of capacity remains in the batteries. If the alarm were base upon both the voltage across the pass transistor and the load current, the controller could make a "more reasoned" determination of when to reduce operations (and load current), whether through power-cycling, disabling some functions, powering down after storing vital information.

For the forgoing reasons, there is a need for a voltage regulator which provides an indication that the input voltage to the regulator is too low to provide a regulated output voltage for the load attached to the regulator at the time.

SUMMARY OF THE INVENTION

The invention seeks to provide protection circuitry for a linear voltage regulator which indicates when the voltage across the regulator's pass transistor has reached a threshold beyond which further diminution of the input voltage, without a decrease in the load current, could cause the regulator to go out of regulation. The circuitry senses the voltage across the regulator's pass transistor and its output current and activates an output alarm whenever the sensed voltage is insufficient for regulation at the sensed output current level.

The invention's voltage-sense and alarm circuitry provides an alarm which is based, in part, upon the voltage across the regulator's pass transistor; when the voltage across the pass transistor drops to a predetermined level, the alarm is activated. Trigger offset circuitry is also included which permits adjustment of the trigger-voltage at which the voltage sense and alarm circuit activates the alarm signal, allowing the trigger voltage to be set below the threshold voltage of the circuit devices in the sense and alarm circuit. The invention's current sense and adjustment circuitry dynamically adjusts the voltage trigger-level in response to the voltage regulator's output current; the voltage trigger-level is increased for increased output current and decreased for decreased output current.

The invention also includes operational circuits and systems which employ the alarm output from the voltage regulator to take corrective action whenever the regulator's output threatens to go out of regulation.

These and other features and advantages of the invention will be apparent to those skilled in the art from the following detailed description, taken together with the accompanying drawings.

DETAILED DESCRIPTION OF THE INVENTION

Figure 1:
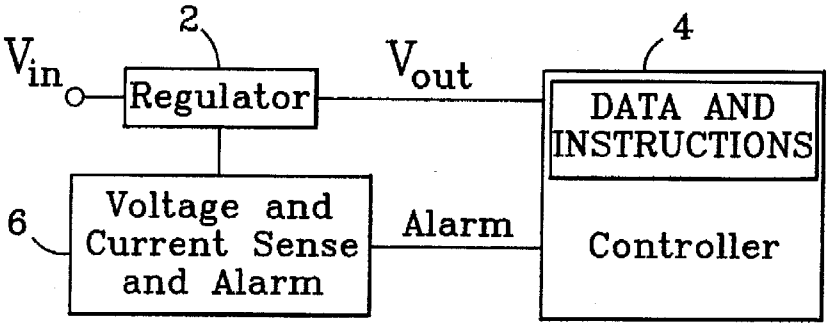
FIG. 1 is a block diagram of a regulator that has an alarm output in accordance with the invention and supplies a controller.

The block diagram of FIG. 1 illustrates a system which employs the invention's voltage- and current-based alarm. A regulator 2 receives an unregulated input voltage, $V_{in}$, and produces a regulated output voltage, $V_{out}$, for use by a controller 4. Because voltage regulators are employed in virtually all electronics systems, the controller could be employed by any of a myriad types of systems, but battery—operated systems such as laptop computers, cellular telephones and hand-held data-processors and communications devices are particularly suited for operation with the inventive alarm system.

The sense and alarm block 6 senses the voltage across the pass transistor of the regulator 2 and the current flowing from the transistor's output $V_{out}$ into the controller 4. The sense and alarm block 6 activates the alarm output to the controller 4 whenever the voltage across the pass transistor of the regulator 2 is inadequate for proper regulation.

The controller 4 recognizes the alarm and, in response, adjusts the current it draws from the regulator 2. The controller 4 may effect this adjustment in a number of ways. For example, the controller 4 (i.e. a microprocessor, microcontroller, state logic, etc.) could, upon receiving an alarm from the sense and alarm circuitry 6, store critical data, register values and instructions, then "power down". Alternatively, the controller could terminate high-power operations such as printing or radio transmissions, or it could reduce power consumption through power-switching (e.g. extend the period between driving the pins on a dot-matrix printer) or by gradually reducing power to such functions as back-lighting of a system's liquid crystal display (Power conservation techniques, including power-switching, are described in, Paul Horowitz, Winfield Hill, *The Art of Electronics*, Cambridge University Press, New York, 1989, pages 938–939).

Figure 2:
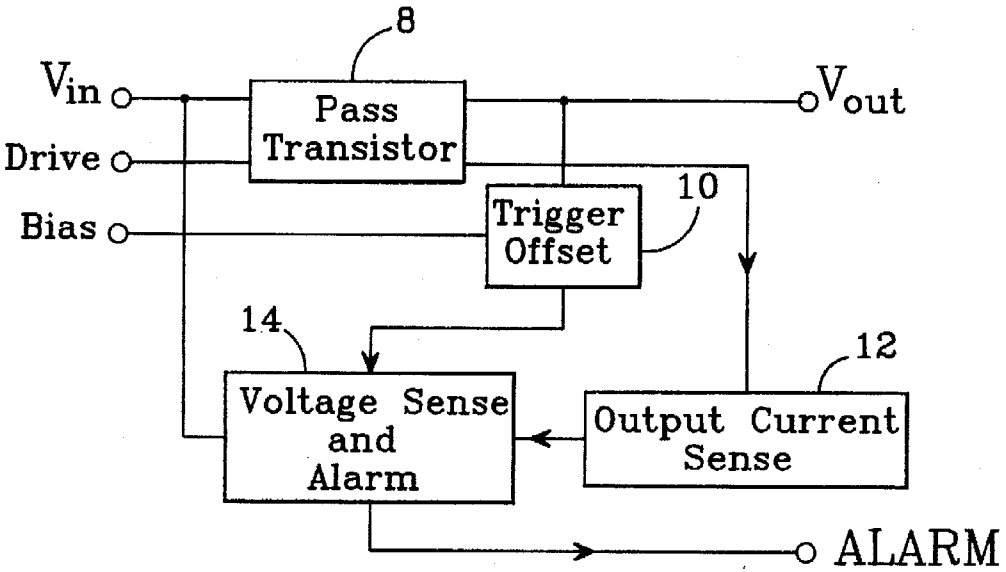
FIG. 2 is a block diagram of a voltage regulator with voltage and current sensing and an alarm output.

FIG. 2 is a block diagram of the sense and alarm block 6 of FIG. 1. An unregulated voltage, $V_{in}$, is regulated by the pass transistor 8 to provide the regulated output voltage $V_{out}$. The pass transistor 8 is driven by a bias circuit (not shown) which senses $V_{out}$, compares it to a reference voltage and adjusts the drive to reduce the difference between $V_{out}$ and the value specified for $V_{out}$. Such a voltage regulator is described in H. E. Lin, *Electronic Designers' Handbook*, Robert W Landee, Donovan C. Davis, Albert P. Albrecht editors, McGraw Hill Book Company, New York 1977, page 11–24. The bias circuit is connected to the pass transistor 8 through the DRIVE input.

A trigger offset block 10 provides a voltage offset between $V_{out}$ and the sense and alarm circuitry. As will be described in greater detail below, the offset block 10 compensates for the variation in critical parameters that are an inevitable feature of integrated circuit manufacturing. Additionally, the offset eases the initial establishment of an alarm trigger-level.

A voltage sense and alarm block 14 senses the voltage across the pass transistor 8 and trigger offset 10. Additionally, the voltage sense and alarm block receives feed-back from an output current sense block 12 to adjust the alarm trigger-voltage established by the voltage sense block 14. That is, as the current supplied by the regulator 2 increases, the headroom required for regulation increases and the current sense block 12 adjusts the alarm trigger-voltage correspondingly. Suppose, for example, $V_{out}$ is specified as 5 V and the alarm trigger-voltage is initially set so that the alarm is triggered when $V_{in}-V_{out}=0.5$ V, or $V_{in}=5.5$ V (assuming 10 mA and 50Ω collector resistance for a PNP pass transistor). If the output current increases to 20 mA, the current sense block modifies the trigger-voltage so that the alarm is triggered when $V_{in}-V_{out}=1.0$ V, or $V_{in}=6.0$ V. The bias input simply provides minimal drive current for circuitry within the trigger offset block 10.

Figure 3:
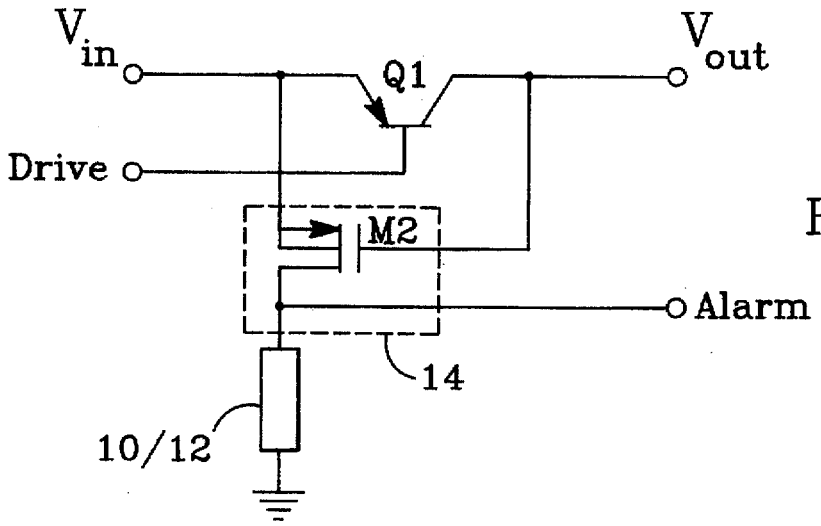
FIG. 3 is a schematic diagram of voltage sense and alarm circuitry employed in a preferred implementation of the FIG. 2 circuitry.

FIG. 3 illustrates, in greater detail, a preferred implementation of the voltage sense and alarm circuitry 14 of FIG. 2. In the preferred embodiment, the pass transistor $Q_1$ is implemented as a PNP transistor with its emitter connected to $V_{in}$ and the regulated output voltage $V_{out}$ taken from $Q_1$'s collector. Current sunk from $Q_1$'s base by the DRIVE input, as discussed above, maintains $V_{out}$ at the specified voltage level.

In the preferred embodiment the voltage sense and alarm circuit is implemented as a p-channel MOSFET $M_2$; it could alternatively be implemented with an n-channel MOSFET or a bipolar transistor. $M_2$'s source is connected to $V_{in}$; its gate is connected to the trigger offset circuitry 10 but for simplicity of explanation, $M_2$'s gate is shown in FIG. 3, connected directly to $V_{out}$. This view is further simplified by treating the trigger offset 10 and output current sense block 12 as a simple load 10/12 and showing $M_2$'s drain connected through the block 10/12 to ground. The drain also provides the alarm output, ALARM.

$M_2$'s gate-to-source voltage $V_{GS2}$ is equal to $Q_1$'s collector-to-emitter voltage $V_{CE1}$, which is equal to $V_{in}-V_{out}$. Therefore, if $V_{in}-V_{out}$ is greater than $M_2$'s threshold voltage $V_{T2}$, $M_2$ is "on" and the alarm output ALARM is "high" and inactive, indicating that the voltage across the pass transistor $Q_1$ is great enough to maintain regulation. If $V_{in}-V_{out}$ is less than $M_2$'s threshold voltage $V_{T2}$, $M_2$ turns "off" and its drain is pulled "low" by the load to activate ALARM. To this point in the explanation, the alarm trigger is determined by $M_2$'s threshold voltage $V_{T2}$. For example, if $V_{T2}$ is 1.2 V and $V_{out}$ is specified as 5 V, the alarm will be activated whenever $V_{in}$ drops below 6.2 V.

Figure 4:
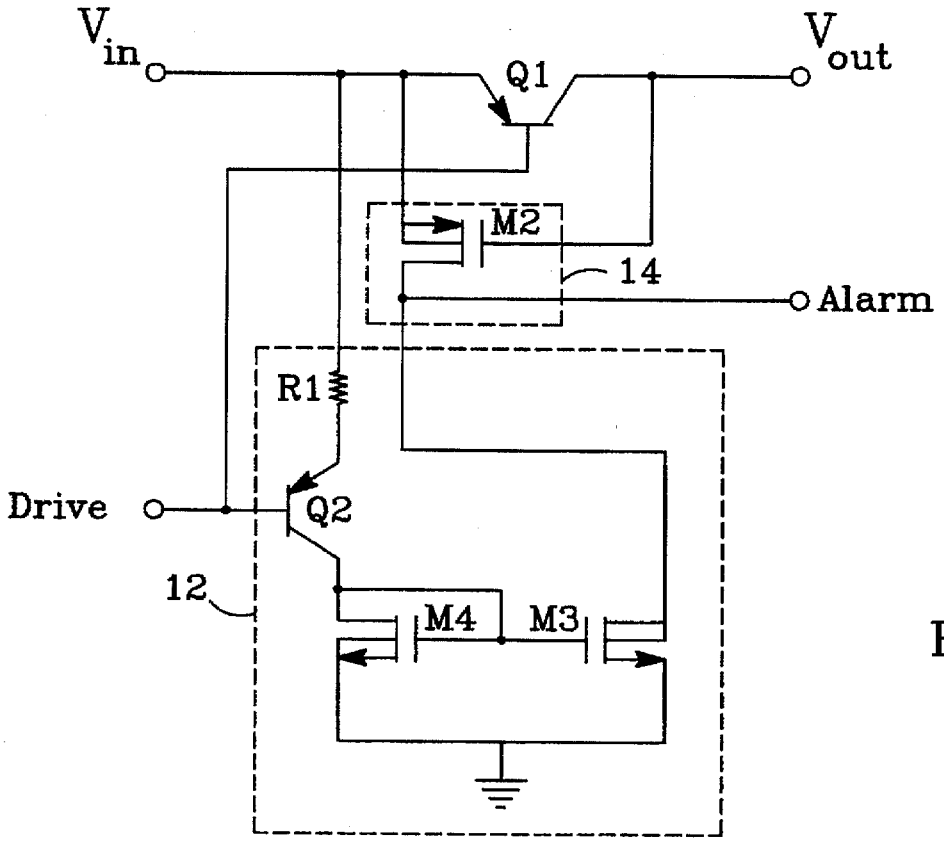
FIG. 4 is a schematic diagram of the circuitry of FIG. 3, with the addition of output current sense and compensation circuitry.

FIG. 4 adds the output current sense and compensation circuitry 12 to the circuitry of FIG. 3. Circuit 12 includes resistor $R_1$, a current mirror formed by a pair of n-channel MOSFETs, $M_3$ and $M_4$, and a pnp bipolar transistor $Q_2$ which receives the DRIVE input at its base and has its inter-collector circuit connected between $R_1$ and the $M_3/M_4$ mirror. Ignoring $R_1$ and the $M_3/M_4$ current mirror for the moment, the base-to-emitter voltage $V_{BE1}$ of PNP $Q_1$ would be equal to the base-to-emitter voltage $V_{BE2}$ of $Q_2$. Consequently, if $Q_1$ and $Q_2$ are matched transistors, their collector currents would be equal (in the preferred embodiment $Q_1$ and $Q_2$ are implemented as PNP transistors but they could alternately be implemented as p-channel MOSFETs). However, in the preferred embodiment the area of $Q_1$ is actually 180 times that of $Q_2$. This ratio reduces the current flowing through $Q_2$ ($I_{C2}$) to 1/180 if the current $I_{C1}$ flowing through $Q_1$. That is, $I_{C2}$ is a measured ratio of the output current $I_{C1}$ (assuming the gate currents of $M_2$, $M_3$, and $M_4$ are zero). The resistor $R_1$, connected between $V_{in}$ and $Q_1$'s emitter, further reduces $Q_2$'s collector current by reducing $V_{BE2}$; this reduction in current is important for low-power operation.

MOSFETs $M_3$ and $M_4$ form a current mirror in which $M_4$'s drain current (which is equal to $Q_2$'s collector current, ignoring second order gate currents) is equal to $M_3$'s drain current, which is pulled through the voltage sense FET $M_2$ ($M_3$and $M_4$ could be scaled to further adjust $M_2$'s drain current) As the regulator's output current $I_{C1}$ increases, the increase is sensed by $Q_2$ and reflected through the $M_3/M_4$ current mirror. As a result, more current is pulled through MOSFET $M_2$, thus requiring a higher $V_{GS2}$ to keep $M_2$ turned on (and the alarm inactive). That is, since drain current is proportional to the amount by which the FET's gate-to-source voltage exceeds its threshold voltage, attempting to pull more drain current through $M_2$ than $V_{GS2}$ will support turns $M_2$ off. The drain current/gate-to-source voltage relationship is given by:

$$\{I_D/\beta[V_{DS}(1+\partial V_{DS})]\}+V_{DS}/2=(V_{GS}-V_T)$$

where:

$I_D$=the drain current, $V_{DS}$=the drain-to-source voltage, $V_{GS}$=the gate-to-source voltage, $V_T$=the threshold voltage, $\partial$=the channel length modulation parameter, and $\beta=(\mu)\ (C_{ox})\ (W/L)$ where:

$\mu$ is the p-channel FET mobility,

W is the p-channel FET channel width,

L is the p-channel FET channel length, and $C_{ox}$ is the capacitance per unit area of gate oxide. (see Phillip E. Allen, Douglas R. Holberg, *CMOS Analog Circuit Design*, Holt, Rinehart and Winston, Inc., New York, 1985, pages 95–101).

Thus, in addition to the basic trigger-voltage established by requiring $V_{CE1}$ to be greater than $M_2$'s threshold voltage, the alarm trigger-voltage is adjusted by the requirement that $V_{GS2}$ increase with increasing $V_{out}$ current. In this way, the alarm circuit responds to the variation in headroom which accompanies a variation in the regulator's output current.

With the circuit as described up to this point, the basic alarm trigger-voltage (ignoring the adjustment due to the current-sense circuit) is equal to $M_2$'s threshold voltage, $V_{T2}$. It would be difficult to match $M_2$'s threshold voltage to the alarm trigger voltage, which is determined by the system's anticipated current draw and collector resistance of the pass transistor $Q_1$. For example, $V_T$ is typically 1 V±0.2 V and, for low-power battery-operated applications, the appropriate trigger voltage may be as low as 0.3 V. Setting the initial trigger voltage at 1 V±0.2 V (i.e. $V_T$) would activate the alarm signal while a significant amount of useful capacity remained in the battery (e.g. there would still be room for a 1.2 V−0.3 V=0.9 V drop in battery voltage). Additionally, $V_T$ is temperature-dependent and typically varies from one production run to another, further complicating the task of establishing the trigger—voltage.

Figure 5:
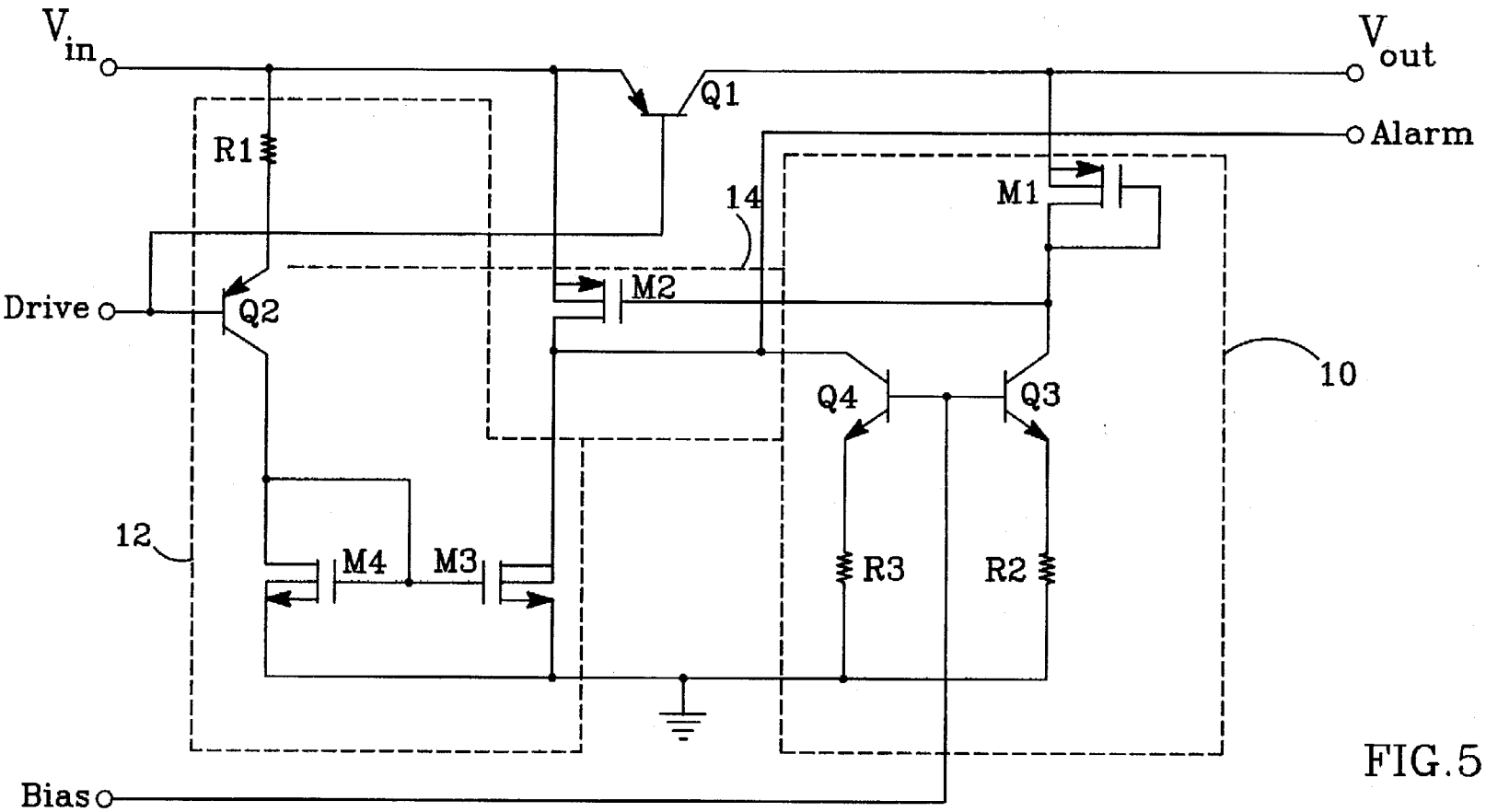
FIG. 5 is a schematic diagram of the circuitry of FIG. 4, with the addition of trigger offset circuitry.

In FIG. 5 the preferred implementation for the offset circuit 10 comprising FET $M_1$ and current sources $Q_3/_2$ and $Q_4/R_3$, is added to the schematic diagram, completing the circuit of FIG. 2. $M_1$ is connected as a diode with its source connected to $V_{out}$ and its gate and drain jointly connected to both the collector of $Q_3$ and the gate of $M_2$, while the collector of $Q_4$ is connected to the drain of $M_2$ and the ALARM output. The offset circuit 10 permits the establishment of an alarm trigger-voltage which is less than $V_T$ and compensates for temperature- and manufacturing-dependent variations in $V_T$. In the illustrated preferred embodiment, the current sources are implemented with bipolar npn transistors, but could alternately be implemented with MOSFETs.

To understand the operation of the offset circuit, assume that $M_1$ and $M_2$ are the same size and that the current sources $Q_3$ and $Q_4$ draw the same amounts of current. In this case, if $M_1$ is "on", $M_2$ (whose gate is connected to the gate of $M_1$) is also "on". Now assume $M_2$ is smaller than $M_1$, in this case the gate-to-source voltage required to maintain the same drain current through $M_2$ as through $M_1$ would be greater for $M_2$ than for $M_1$. $M_2$'s source voltage would have to be greater than $M_1$'s source voltage to keep $M_2$ on (and keep the alarm inactive). Similarly, if $M_1$ and $M_2$ were the same size, but the $Q_4$ current source drew more current than the $Q_3$ current source, $M_2$'s source voltage would have to be greater than $M_1$'s source voltage to keep $M_2$ on. Thus, to adjust the alarm's trigger level, the FETs M1 and M2 and/or the current sources formed by Q3 and Q4 are ratioed (again, using the relationship: $\{I_D/\delta[V_{DS}(1+\partial V_{DS})]\}+V_{DS}/2=(V_{GS}-V_T)$).

The forgoing description of specific embodiments of the invention has been presented for the purposes of illustration and description. It is not intended to be exhaustive or to limit the invention to the precise forms disclosed, and many modifications and variations are possible in the light of the above teachings. The embodiments were chosen and described in order to best explain the principles of the invention and its practical application and to thereby enable others skilled in the art to best utilize the invention. It is intended that the scope of the invention be limited only by the claims appended hereto.

We claim:

1. An electronic system, comprising:

a linear voltage regulator having a pass transistor with an input terminal connected to receive an unregulated voltage and an output terminal providing load current at a regulated output voltage, a voltage sensor connected across the input and output terminals of said pass transistor to sense the difference between said regulated and unregulated voltages, an alarm circuit including circuitry connected to establish a trigger voltage indicative of the regulator's imminent loss of regulation, and a current sensor connected to sense said load current and to adjust said trigger voltage in response to changes in said load current, said alarm circuit connected to activate an alarm signal whenever the voltage sensed by said voltage sensor equals said trigger voltage, and a controller which takes preventive and corrective measures in response to the activation of said alarm circuit.

2. The system of claim 1, wherein the preventive and corrective measures comprise the reduction of system power consumption.

3. The system of claim 2, wherein the preventive and corrective measures further comprise the storage of data and instructions.

4. The system of claim 1, wherein the alarm circuit is activated by a trigger-level voltage sensed by said voltage sensor.

5. The system of claim 4, further comprising a current -sensor which senses the regulator's output current and modifies said alarm circuit's trigger-level voltage in correspondence with the amount of said output current.

6. The system of claim 5, further comprising a trigger offset interposed in series between the pass transistor's output terminal and the voltage sensor so that the voltage sensor senses the sum of voltages across the pass transistor and trigger offset.

7. The system of claim 6, wherein the voltage sensor comprises a p-channel MOSFET having gate, source and drain, with said source connected to the input terminal of the voltage regulator, said gate connected to the output terminal and said drain connected to said alarm circuit.

8. The system of claim 7, wherein the trigger-level voltage is determined by the threshold voltage of said MOSFET.

9. The system of claim 8, wherein the current sensor comprises a transistor, the collector current of which mirrors the pass transistor's output current, and a current mirror, the programmed current of which is equal to said collector current, the mirrored current of which is a portion of the voltage sensor's drain current.

10. The system of claim 9, wherein the trigger offset comprises a p-channel MOSFET having gate, source and drain and a pair of current sources, said gate and drain connected to said voltage sensor's gate and to one of said current sources, said source connected to said regulator's output terminal, said drain of said voltage sensor connected to the other current source.

11. A linear voltage regulator having a pass transistor with an input terminal connected to an unregulated voltage source and an output terminal providing load current at a regulated output voltage, comprising:

a voltage sensor connected across the input and output terminals of said pass transistor to sense the difference between said regulated and unregulated voltages, and an alarm circuit including circuitry connected to establish a trigger voltage indicative of the regulator's imminent loss of regulation and a current sensor connected to sense said load current and to adjust said trigger voltage in response to changes in said load current, said alarm circuit connected to activate an alarm signal whenever the voltage sensed by said voltage sensor equals said trigger voltage.

12. The voltage regulator of claim 11, wherein the alarm circuit is activated by a trigger-level voltage across the pass transistor.

13. The voltage regulator of claim 12, further comprising a current-sensor which senses the regulator's out-put current and modifies said alarm circuit's trigger-level voltage in correspondence with the amount of said output current.

14. The voltage regulator of claim 13, further comprising a trigger offset interposed in series between the pass transistor's output terminal and the voltage sensor so that at the voltage sensor senses the sum of voltages across the pass transistor and trigger offset.

15. The voltage regulator of claim 14, wherein the voltage sensor comprises a p-channel MOSFET having gate, source and drain, with said source connected to the input terminal of the voltage regulator, said gate connected to the output terminal and said drain connected to said alarm circuit.

16. The voltage regulator of claim 15, wherein the trigger-level voltage is determined by the threshold voltage of said MOSFET.

17. The voltage regulator of claim 16, wherein the current sensor comprises a transistor, the collector current of which mirrors the pass transistor's output current, and a current mirror, the programmed current of which is equal to said collector current, the mirrored current of which is a portion of the voltage sensor's drain current.

18. The voltage regulator of claim 17, wherein the trigger offset comprises a p-channel MOSFET having gate, source and drain and a pair of current sources, said gate and drain connected to said voltage sensor's gate and to one of said current sources, said source connected to said regulator's output terminal, said drain of said voltage sensor connected to the other current source.

19. A linear voltage regulator having a pass transistor with an input terminal connected to an unregulated voltage and an output terminal providing load current at a regulated output voltage, comprising:

a voltage sensor having first and second input terminals respectively connected across the input and output terminals of said pass transistor to sense the difference between said regulated and unregulated voltages, an alarm circuit including circuitry connected to establish a trigger voltage indicative of the regulator's imminent loss of regulation and a current sensor connected to sense said load current and to adjust said trigger voltage in response to changes in said load current, said alarm circuit connected to activate an alarm signal whenever the voltage sensed by said voltage sensor equals a trigger voltage, and a trigger offset interposed in series between the pass transistor's output terminal and the voltage sensor's second input terminal so that the voltage sensor senses the sum of voltages across the pass transistor and trigger offset.

20. The voltage regulator of claim 19, wherein the voltage sensor comprises a p-channel MOSFET having gate, source and drain, with said source connected to the input terminal of the voltage regulator, said gate connected to the output terminal and said drain connected to said alarm circuit.

21. The voltage regulator of claim 20, wherein the trigger-level voltage is determined by the threshold voltage of said MOSFET.

22. The voltage regulator of claim 21, wherein the current sensor comprises a transistor, the collector current of which mirrors the pass transistor's output current, and a current mirror, the programmed current of which is equal to said collector current, the mirrored current of which is a portion of the voltage sensor's drain current.

23. The voltage regulator of claim 22, wherein the trigger offset comprises a p-channel MOSFET having gate, source and drain and a pair of current sources, said gate and drain connected to said voltage sensor's gate and to one of said current sources, said source connected to said regulator's output terminal, said drain of said voltage sensor connected to the other current source.

* * * * *

UNITED STATES PATENT AND TRADEMARK OFFICE

CERTIFICATE OF CORRECTION

PATENT NO. : 5,666,043

DATED : September 9, 1997

INVENTOR(S) : Peter S. Henry, Evaldo M. Miranda

It is certified that error appears in the above-identified patent and that said Letters Patent is hereby corrected as shown below:

On the cover page, in the title: delete "CURRENCY" and substitute --CURRENT--.

Column 1, line 2, delete "CURRENCY" and substitute --CURRENT--.

Signed and Sealed this

Third Day of February, 1998

*Attest:*

*Attesting Officer*

BRUCE LEHMAN

*Commissioner of Patents and Trademarks*